US008356736B2

(12) United States Patent
Musgrave

(10) Patent No.: US 8,356,736 B2
(45) Date of Patent: Jan. 22, 2013

(54) PORTABLE GADGET-HOLDING DEVICE

(76) Inventor: Holly Musgrave, Mesa, AZ (US)

( * ) Notice: Subject to any disclaimer, the term of this patent is extended or adjusted under 35 U.S.C. 154(b) by 175 days.

(21) Appl. No.: 12/835,097

(22) Filed: Jul. 13, 2010

(65) Prior Publication Data

US 2011/0011906 A1 Jan. 20, 2011

Related U.S. Application Data

(60) Provisional application No. 61/225,244, filed on Jul. 14, 2009.

(51) Int. Cl.
*A45F 5/00* (2006.01)

(52) U.S. Cl. ..... 224/197; 224/269; 224/271; 224/666; 224/677; 224/930

(58) Field of Classification Search ..... 224/197, 224/199, 660, 666, 669, 677, 678, 676, 269, 224/930, 271, 198, 200, 254, 251; D3/207, D3/215, 218; 24/3.11, 3.12
See application file for complete search history.

(56) References Cited

U.S. PATENT DOCUMENTS 1,571,425 A * 2/1926 Mataloni ..... 70/459
2,581,825 A * 1/1952 You ..... 24/3.6
3,929,266 A * 12/1975 Kim ..... 224/255
4,166,557 A * 9/1979 Conley ..... 224/663
4,226,105 A * 10/1980 Wehrman ..... 70/456 R
4,957,232 A * 9/1990 Sprague ..... 224/674
4,977,860 A * 12/1990 Harwell ..... 119/794
6,038,742 A * 3/2000 Patterson ..... 24/3.12
6,305,588 B1 * 10/2001 Michel et al. ..... 224/271
6,334,239 B1 * 1/2002 Kraut ..... 24/3.6
6,364,184 B1 * 4/2002 Hauck et al. ..... 224/271
6,626,333 B2 * 9/2003 Levesque et al. ..... 224/148.6
6,955,280 B2 * 10/2005 Saitoh et al. ..... 224/269
2005/0035161 A1 * 2/2005 Shioda ..... 224/194
2007/0170220 A1 * 7/2007 Fragassi, III ..... 224/660
2007/0215659 A1 * 9/2007 Knapp et al. ..... 224/269
2007/0245528 A2 * 10/2007 Vermillion ..... 24/3.12

OTHER PUBLICATIONS

Richco, Inc., Twist Lok or Twist Lock, product TL-350. See, e.g., www.richco-inc.com. (2 pages of relevant screen shots submitted herewith).

* cited by examiner

*Primary Examiner* — Justin Larson
(74) *Attorney, Agent, or Firm* — Venable, Campillo, Logan & Meaney, P.C.

(57) ABSTRACT

A gadget holding device for releasably holding a cell phone, an ipod or other similar gadget on a users clothing, belt or purse. The gadget holding device preferably comprising a clip, a D-ring, and a hanging interlock clasp, wherein the D-ring connects the clip to the hanging interlock clasp that permits the D-ring to rotate relative to the clip and the hanging interlock clasp to rotate and slide relative to D-ring. This configuration releasably holds a gadget and enables easy one-handed release from the gadget holding device. In this way, the gadget-holding device is a sleek, flat, lightweight, fashionable and ultimately inconspicuous way to carry a cell phone, music player or any other gadget on a person comfortably.

1 Claim, 12 Drawing Sheets

PORTABLE GADGET-HOLDING DEVICE

CROSS-REFERENCE TO RELATED APPLICATIONS

The present application claims priority to United States provisional patent application entitled "Portable Gadget-Holding Device," having Ser. No. 61/225,244, filed on Jul. 14, 2009, which is entirely incorporated herein by reference.

BACKGROUND OF THE INVENTION

1. Field of the Invention

This invention relates generally to devices for releasably holding a personal gadget, and more specifically to a device for releasably holding a cell phone, an ipod or other similar gadget on a user's belt or clothing.

2. Description of the Related Art

While there are many different options available on the market for carrying devices such as cellular phones, music players, etc., nothing exists that is both functional and aesthetically pleasing—particularly for a woman. Bulky carriers that sit at the waistband create a bulge under the shirt if worn un-tucked and ultimately make the waist look larger, something a woman avoids at all costs. Also, while there are many holders that attempt to be fashionable by means of color and style, their bulkiness causes many women shy away from wearing them unless ultimately necessary for whatever reason. This can create a variety of problems for those who carry cell phones but have no desirable means of carrying them on their person. For example, important phone calls can be missed because the phone has been lost in the bottom of a purse, or inadvertently left in another room. Also, many women are fashion conscious and would prefer that their expensive phone or the latest ipod is not covered by some bulky case. In many instances, a phone or gadget purchase was made because of the way that it looked. Covering up the sleek look of the newest gadget on the market is not desirable either.

In addition, while available gadget holders may function adequately for men, they still present the problem of being bulky and in many informal settings when guys wear their shirts un-tucked, the bulk at the waistband can be undesirable. It also makes it inconvenient to use the gadget when it is hidden way up under the shirt. Being able to wear a more comfortable, convenient, inconspicuous and yes, fashionable gadget or cell phone holder, appeals to men as well as women.

What is needed is a sleek, flat, lightweight, fashionable and ultimately inconspicuous way to carry a cell phone, music player or any other gadget on a person comfortably.

SUMMARY OF THE INVENTION

The invention is summarized below only for purposes of introducing embodiments of the invention. The ultimate scope of the invention is to be limited only to the claims that follow the specification.

Generally, the present invention comprises a gadget-holding device that is a sleek, flat, lightweight, fashionable and ultimately inconspicuous way to carry a cell phone, music player or any other gadget on a person comfortably.

The preferred embodiment of the invention comprises a clip, a connector, and a hanging interlock clasp wherein the connector is connected between the clip and the hanging interlock clasp. A D-ring is the preferred connector. More specifically, the straight leg of the D-ring should be connected to the clip so that the D-ring can rotate relative to the clip; and, the D-ring should be connected to the hanging interlock clasp so that the hanging interlock clasp can rotate and slide relative to D-ring.

One object of the invention is to allow a user to both lock and release the gadget from the gadget holding device using only one hand.

Another object of the invention is to permit some usage of the device without having to remove it from the holder. For example, one advantage of the preferred embodiment is that a user can view the gadget's screen and operate some functions while sitting or standing without having to remove the gadget from the holder.

BRIEF DESCRIPTION OF THE DRAWINGS

FIG. 3 illustrates a double sided adhesive tab used to attach the engagement button 50 to the back of a gadget 8 for use in conjunction with the embodiment shown in FIG. 1.

DESCRIPTION OF EMBODIMENTS

It is to be understood that the descriptions below are merely illustrative of various embodiments of the invention and that no limitations are intended to the detail of construction or design herein shown other than as defined in the appended claims.

Figure 1:
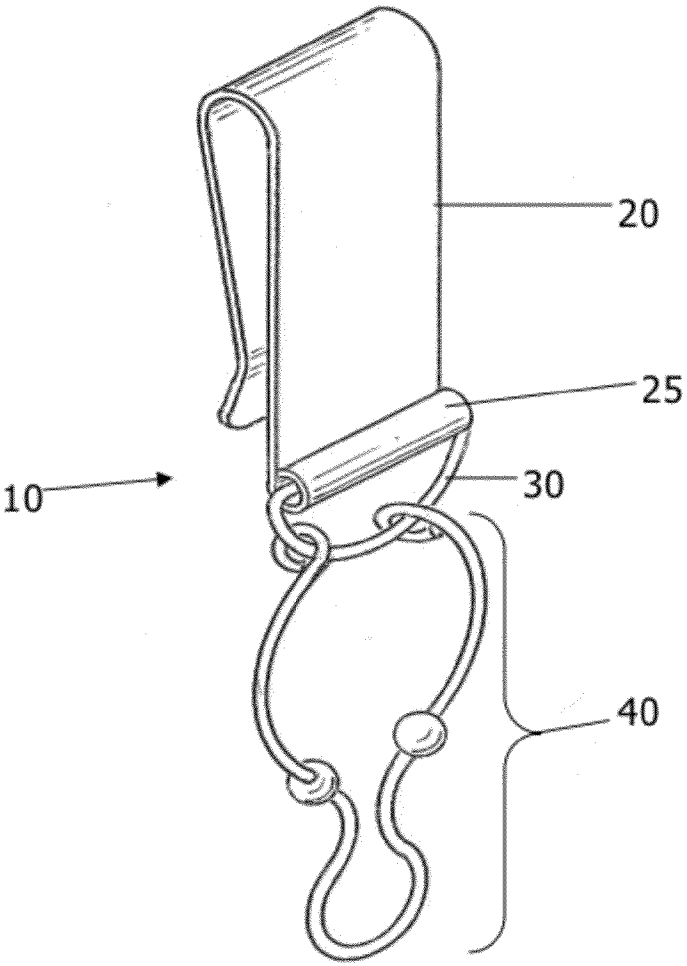
FIG. 1 shows an embodiment of the gadget-holding device 10. While this embodiment is suitable, it is preferred to add a covering as shown and discussed in relation to FIG. 18. A covering is preferred but not required to function in the manner intended. When a covering is used, cylinder 25 is not needed as discussed below in paragraph [048] as the covering can be configured to function in place of cylinder 25.
Figure 3:
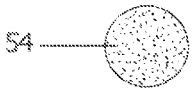
FIG. 3 illustrates a back elevation view of the preferred engagement button 50.
Figure 4:
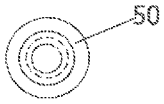
FIG. 4 is a front elevation view of the preferred engagement button 50 used in conjunction with the embodiment shown in FIG. 1

FIG. 1 illustrates an embodiment of the gadget-holding device 10. As shown, this embodiment of gadget-holding device 10 comprises three parts: a clip 20, a connector (preferably, D-ring 30), and a hanging interlock clasp 40. The preferred embodiment is shown in FIGS. 28-34. While the embodiment illustrated in FIG. 1 will function according to the principles of this invention, it is preferred to add a covering as shown and discussed in relation to FIG. 18—even though a covering is not necessary. A covering is preferred for its aesthetical appeal, but also because a covering provides some additional rotational frictional forces that keep the gadget from rotating too freely about the engagement button 50.

Figure 2:
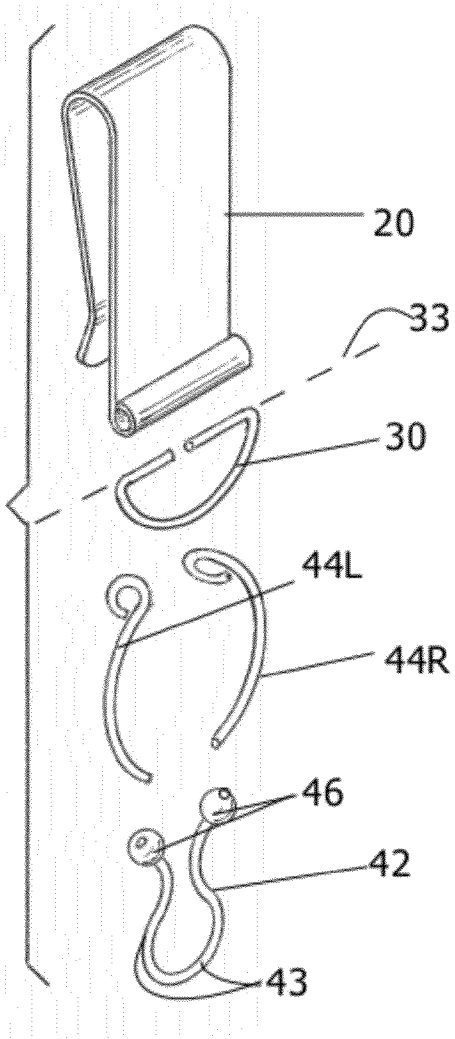
FIG. 2 illustrates an exploded perspective view of the embodiment shown FIG. 1.
Figure 18:
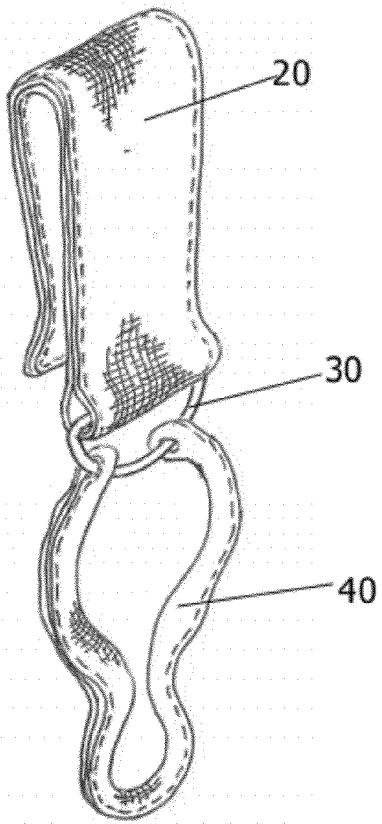
FIG. 18 is a perspective view of the preferred embodiment of a gadget-holding device 10. The preferred embodiment combines the elements shown in FIG. 1 enveloped in a covering such as fabric, leather or plastic for the purpose of fashion and design.
Figure 22:
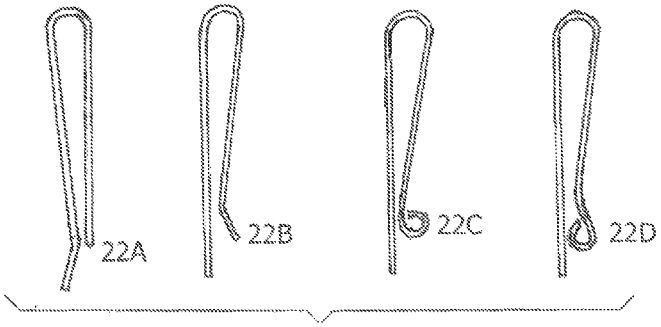
FIGS. 22 A-D illustrate various alternate embodiments of clip 20.

FIG. 2 illustrates an exploded perspective view of the embodiment of FIG. 1. Clip 20 is commercially available in many different shapes, sizes and materials such as metal or plastic. One skilled in the art can select the size, shape or material best suited for the desired end result. FIGS. 22 A-D illustrate various alternate embodiments of clip 20. For example, if the end design will include a covering such as fabric, leather, vinyl or plastic such as used for fashion, then 22A or 22B might be preferable options. In that case, D-ring 30 could be attached to the preferred embodiment by a cylindrical loop of fabric or leather as shown in FIG. 18. Consequently, there would be no need for the cylindrical shape shown at reference character 25 of clip 20. Alternately, if the end design is to be made entirely from, for example, polished stainless steel or plated sterling silver, 22C or 22D might then be a better choice as illustrated in FIG. 1.

D-ring 30 is commercially available in many different sizes, gauges, shapes and finishes. One skilled in the art can select the size, shape or material that is best suited for the desired end result. D-ring 30 serves more than one purpose. It has a working function and a fashion function. Choosing a shape that works properly with hanging interlock clasp 40 for the designated purpose is important to the function and choosing a finish that esthetically complements the finished product whether it be covered or not, is important to the "look" or fashion of the preferred embodiment.

Figure 11:
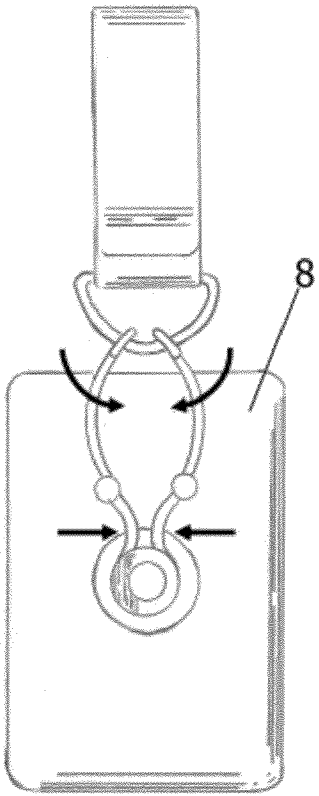
FIG. 11 is a back view of the embodiment shown in FIG. 1, illustrating the third step of the engagement process—the interlocked position.
Figure 10:
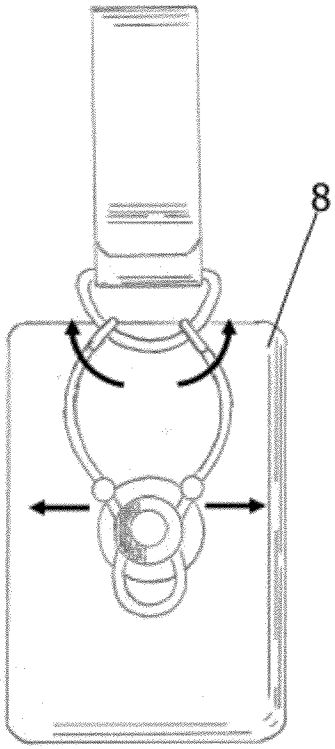
FIG. 10 is a back view of the embodiment shown in FIG. 1, illustrating the second step of the engagement process—as the gadget is moved downward, the engagement button 50 forces the legs of the hanging interlock clasp 40 to widen and the narrow neck of slide lock 42 to flex open and accept the engagement button 50 as it slides down and into the interlocked position.

At a minimum, hanging interlock clasp 40 comprises a slide lock 42. The term "slide lock" refers broadly to any device that can secure engagement button 50 by sliding as shown in the progression from FIG. 9 through FIG. 11. In the interlock position shown in FIG. 11, rotatability of engagement button 50 is preferable, but not required. While those in the art can utilize many items to function as a slide lock 42, a product sold commercially by Richco, Inc. of Morton Grove Illinois under the mark Twist Lok or Twist Lock, product TL-350 can provide suitable results. See, e.g., www.richco-inc.com. While the Twist Lok product sold by Richco, Inc. is intended to be twisted for the purpose of tying wires together, the use contemplated here requires no twisting—just sliding the engagement button 50 down onto slide lock 42 as shown in FIGS. 9-11.

Hanging interlock clasp 40 preferably also comprises extension rings 44L and 44R. When extension rings 44L and 44R are connected to slide lock 42 as shown in the embodiment of FIG. 1, preferred hanging interlock clasp 40 is created. Those in the art can create various alternative embodiments of the hanging interlock clasp 40. The innovative hourglass shape and design of the hanging interlock clasp 40 (not necessarily including connectors 46) is what creates the function for which this design is intended. Hanging interlock clasp 40 can be made out of one material and in one piece or more than one material and have more than one part. An alternate design option where the flex movement of hanging interlock clasp 40 happens at the bottom instead of through the middle or at the top can be employed. It is up to the desire of one skilled in the art to decide which design works best for his purposes, whether the gadget-holding device will be covered in a decorative covering or if the working parts will be exposed to view. The material or materials which make hanging interlock clasp 40 should be rigid enough to hold the general shape but with enough flex ability to "give" in the right places when the proper pressure is applied (whether from above when inserting gadget 8 or from below when removing gadget 8) and then be able to return to the original shape as shown in FIG. 9-11. This could include but is not limited to materials such as plastics and/or spring metals.

The purpose of solid spheres 46 is to connect the slide-lock 42 with the extension loops, but other connection types known in the art can be suitable. It is suitable to use a slide lock 42 having ball-shaped ends that can be drilled deep enough to accept the ends of extension loops 44L and 44R, which can then be inserted and glued if necessary. Connecting extension loops 44L and 44R to slide lock 42 creates the preferred embodiment of hanging interlock clasp 40. Of course, solid spheres 46 are not necessary at all if hanging interlock clasp 40 is fabricated as one piece.

Figure 9:
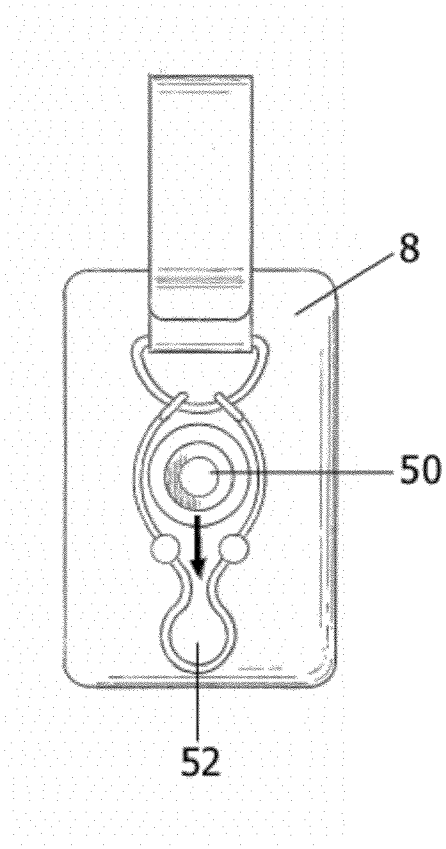
FIG. 9 is a back view of the embodiment shown in FIG. 1, illustrating the first step of the engagement process—the engagement button 50 is in ready position to be moved down and into an interlocked position within the gadget-holding device 10.
Figure 8:
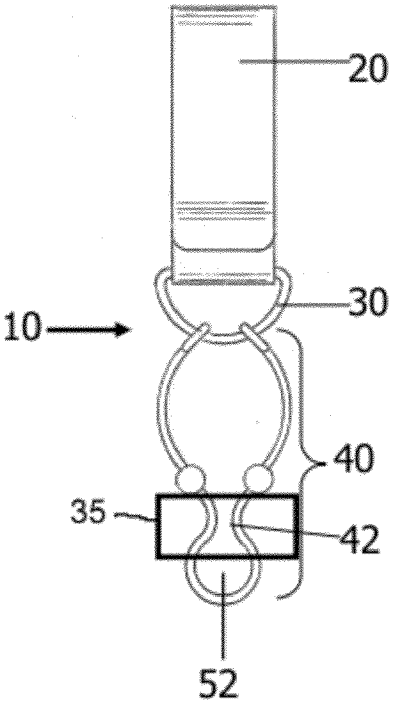
FIG. 8 is a back view of a gadget-holding device 10.

Hanging interlock clasp 40 is designed to accept engagement button 50 into empty space 52 as shown in FIG. 8 and then expand or flex open to allow the engagement button 50 to slip down into empty space 52 and engage as shown in FIG. 9.

The engagement button 50 is commercially available in many different sizes, shapes and colors. Engagement button 50 must be selected to work symbiotically with hanging interlock clasp 40. Many engagement buttons 50 are commercially available and are often attached to protective cases specifically designed to fit a specific gadget, such as a cell phone or personal music player.

It is preferred to employ a "universal" size engagement button, but it is up to one skilled in the art to decide the exact size and shape of engagement button 50 to fit the purposes of the design. Of course, then, those in the art will recognize that hanging interlock clasp 40 should be selected to work symbiotically with a universal size engagement button 50. These purposes may be, but not limited to, function (examples of function may be: 1-allowing a loose, free rotation of button when fully engaged into hanging interlock clasp 40 and thus free rotation of the attached gadget, 2-a tighter yet still free rotation of said gadget made possible when fabric or another decorative medium covers hanging interlock clasp 40 creating a compression-like fit when engagement button 50 slips down into and fills in empty space 52, or 3-a ratcheting action of surface 53L, 53R, 56, 57 or 58 of engagement button 50 interacting with any part of surface 43 of slide lock 42 whether it be by lans and grooves, bumps and divots or any other means of ratcheting action which may be conceived by one skilled in the art.) or fashion (examples of fashion may be 1—colors that "match" or "complement" the colors of the final form of the preferred embodiment or 2—colors that "match" or "complement" the color of the gadget that said engagement button 50 is being attached to and/or 3—the size and shape of the engagement button 50 be esthetically pleasing to the eye when attached to the gadget) or both function and fashion. The slimmer and sleeker the design and shape of the engagement button, along with being less noticeable when attached to the back of a gadget such as a cell phone or personal music player will make it more desirable to those who are fashion conscience. It is for this reason it is desirable to have color options that match the multiple color options available on many gadgets on the market.

Engagement button 50 is preferred to be connected to the portable gadget 8 by means of an adhesive disk 54. While this is one way by which an engagement button 50 can be attached to a gadget of any kind, it is not the only way. Those in the art can select the means of engagement from a variety of known options, gluing, sewing, strapping, screwing or any other suitable method to secure engagement button 50 to gadget 8.

The purpose of clip 20 is primarily two-fold. The first purpose is to attach the preferred embodiment as a whole to another object such as a waistband, belt or the edge of a pocket or purse. This is shown in an example environment in FIGS. 25-27 and FIG. 17 and as a cross section of a belt or waistband 22 engaged between interior surfaces of clip 20 in FIG. 15. The second purpose is to allow for attaching the D-ring 30 and ultimately the hanging interlock clasp 40 with which the engagement button 50 is held. Clip 20 is generally available commercially and thus will not be described in detail in this document. There are many different sizes and shapes available and it is up to one skilled in the art to choose which design best suits the purposes of the chosen embodiment. FIGS. 22A-D are just some examples of clip shapes that may be used. One way to attach D-ring 30 to clip 20 is by having cylindrical shape 25 at the bottom front of clip 20 as shown in FIG. 1.

D-ring 30 is generally commercially available and thus will not be described in detail in this document. D-rings are available in many different shapes, sizes, gauges and finishes and it will be up to one skilled in the art to determine which one best serves the purposes of the design of the chosen embodiment.

FIG. 1 illustrates one way to connect clip 20 with D-ring 30. The horizontal leg of D-ring 30 can be located within a cylindrical tube 25 during fabrication. Of course, other ways can be employed to connect D-ring 30 with clip 20. For example, when a fabric covering is employed as shown in FIG. 18, the fabric can be utilized to hold the D-ring 30 as shown. Regardless of the means used, though, it is preferred that D-ring 30 can rotate about its straight leg in relation to the clip to permit a user to release gadget 8 from gadget-holding device 10 by placing the thumb on the D-ring in the release position shown in FIG. 15 and using the fingers to move the gadget 8 toward D-ring 30 to release gadget 8. Allowing D-ring 30 to pivot along axis 33, forward and back from within cylinder 25 as shown in FIG. 2 is a preferred feature of the invention.

Figure 19:
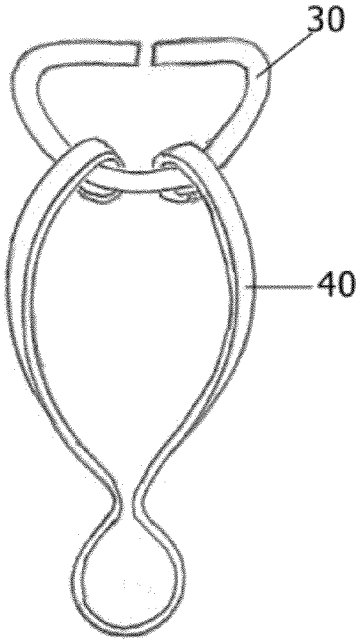
FIG. 19 is a front perspective view of an alternate embodiment of a gadget-holding device 10 using a one piece configuration which could be made from any suitable material such as metal or plastic and a D-ring 30.

Hanging interlock clasp 40 is connected to D-ring 30 by extension loops 44L and 44R as shown in FIGS. 1 and 2. It is preferred that hanging interlock clasp 40 be rotatably and slidably connected to D-ring 30 to permit the movement shown in FIGS. 10, 11, 14-17. It is preferred to shape hanging interlock clasp 40 in the hourglass shape as shown in FIGS. 1 and 19.

Figure 16:
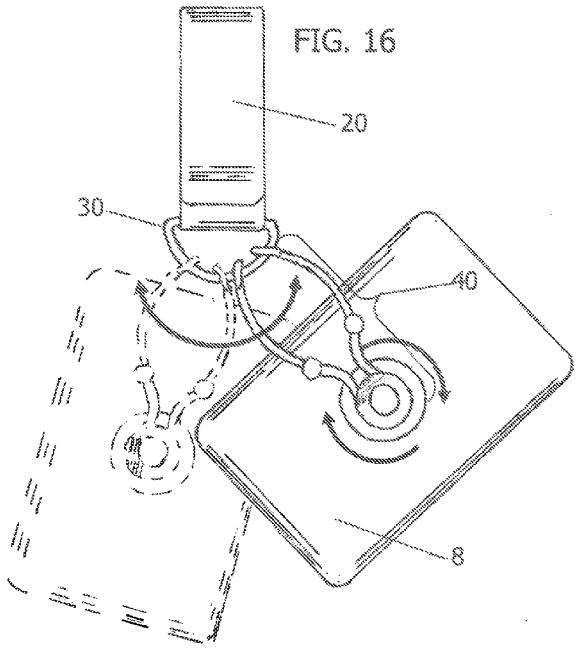
FIGS. 16 & 17 illustrate how the gadget 8 can move freely on the D-ring 30 and rotate about the engagement button 50 in the interlocked position.

As shown in FIG. 1, D-ring 30 runs through the loops shown at 42L and 42R. As a whole, hanging interlock clasp 40 can swing left and right along the curved leg of D-ring 30 as shown in FIG. 16. Hanging interlock clasp 40 can also rotate in the direction indicated in FIG. 17. Also, when materials selected have some "flex" ability, which is preferred, the hanging interlock clasp 40 can move as shown in FIGS. 10 and 11. This flexing movement generally happens when a basic upward pressure is applied from below the preferred embodiment when D-Ring 30 is in the horizontal position.

Figure 17:
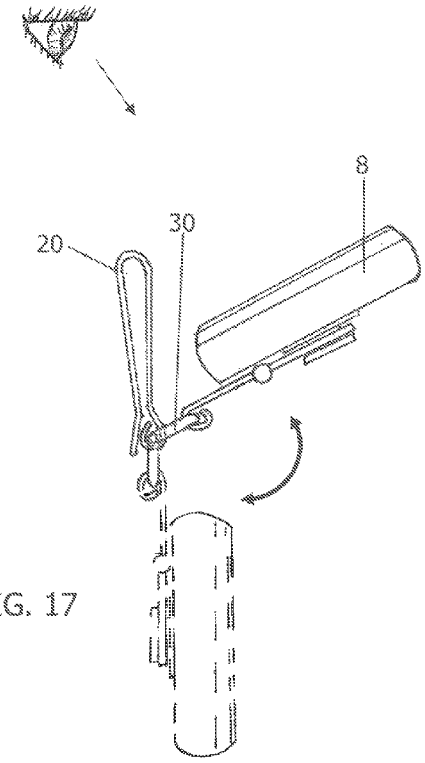
Figure 20:
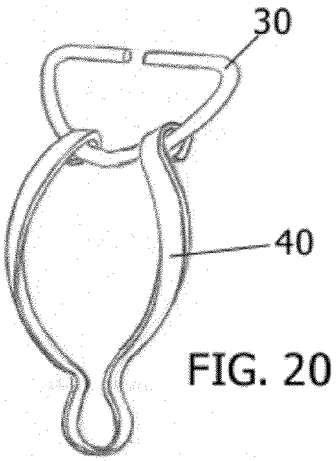
FIG. 20 is another angle of FIG. 19.
Figure 21:
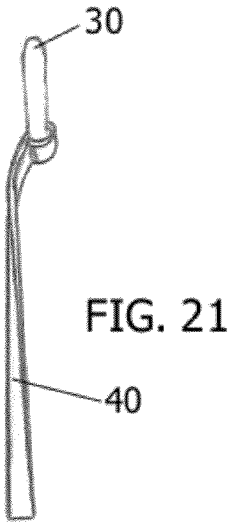
FIG. 21 is a is a side view of FIG. 19

When D-Ring 30 is in the hanging position and pressure is applied from below (i.e., the user does not desire to remove gadget 8 from the gadget-holding device 10), the extension rings will naturally take the path of least resistance and swing or pivot on D-Ring 30 as shown in FIGS. 16 and 17 out of the way instead of forcing the flex action to allow gadget 8 to escape from slide lock 42 of hanging interlocking clasp 40. Gadget 8 may also rotate about engagement button 50 within the slide lock 42 as shown in FIG. 16, which also keeps gadget 8 from becoming disengaged when not desired.

Figures 12, 13, 14, 15:
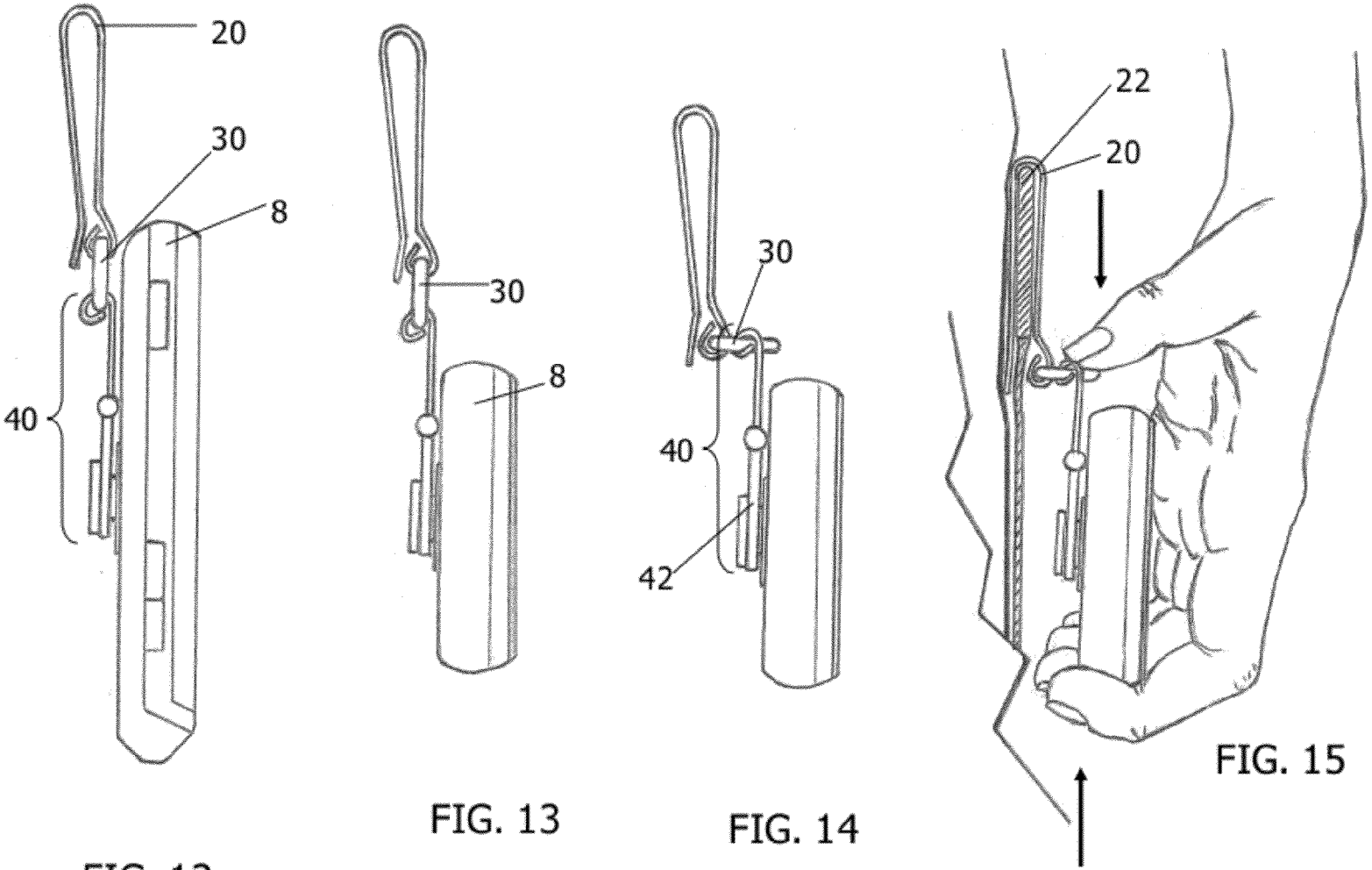
FIG. 12 is a side view of FIG. 11 with the portable gadget 8 in the interlocked position and the D-ring 30 in the hanging position.
FIG. 13 is a side view of FIG. 11 with the portable gadget 8 in the interlocked and the D-ring 30 in the hanging position; with the portable gadget 8 rotated 90 degrees from the position shown in FIG. 12.
FIG. 14 is a side view of FIG. 11 with the portable gadget 8 in the interlocked position and the D-ring 30 in the release position (i.e., rotated 90 degrees about the straight leg of the D-ring 30 from the hanging position).
FIG. 15 is the same view as FIG. 14 with the addition of a user's hand to show how the gadget 8 can be released from the gadget-holding device 10 with one hand: by placing the thumb on the D-ring 30 in the release position and using the fingers to move the gadget 8 toward the D-ring 30 to release it from the slide lock 42 of interlock clasp 40.

Another way this flexing movement can occur is when D-ring 30 pivots forward on axis 33 of cylinder 25 as shown in FIG. 15. The shape and angle of loops 42L and 42R are such that when the angle at which D-ring 30 hangs changes from hanging straight down or vertical position to that of a horizontal position, the loops 42 allow the hanging interlock clasp 40 to rotate relative to D-ring 30. In other words, hanging interlock clasp 40 can maintain a vertical position, so that clip 20 is vertical and at a 90 degree angle from D-ring 30 and hanging interlock clasp 40 is also at a 90 degree angle from D-ring 30, then extension loops 44L and 44R are forced to move in an up and/or outward position on surface 33 of D-ring 30. An example both of the aforementioned actions are illustrated in FIGS. 10, 11, and 15.

Figure 5:
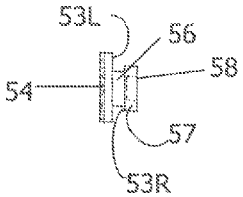
FIG. 5 is a side view of FIG. 3 and FIG. 4 attached to each other by means of adhesion.
Figure 6:
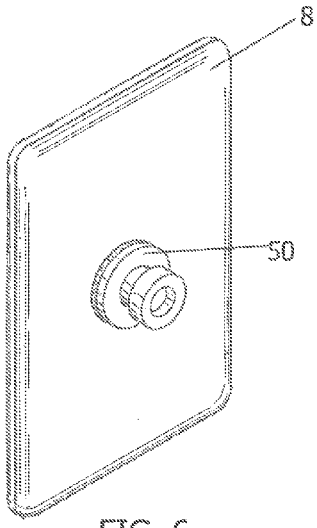
FIG. 6 is a perspective view of FIG. 5 attached to the back of a device or gadget 8 such as a cellular phone or portable music player by means of adhesion thereby creating a method of insertion into the gadget-holding device 10 shown in FIG. 1.
Figure 7:
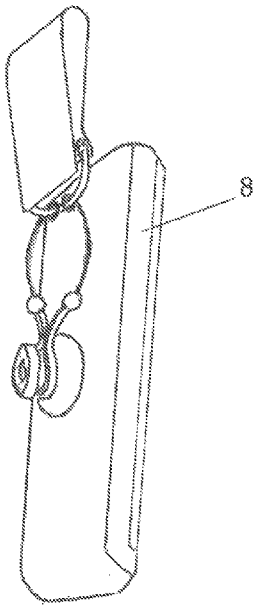
FIG. 7 is the back perspective view of the gadget-holding device 10 releasably holding a gadget 8.

In FIGS. 13-15, gadget 8 has been rotated into a horizontal position as it is attached to engagement button 50, which is fully engaged into hanging interlock clasp 40 of the preferred embodiment. FIG. 15 illustrates the action of removing gadget 8 from gadget-holding device 10 by applying pressure in an upward manner from fingers while simultaneously applying pressure with thumb down on D-ring 30 in a substantially horizontal position. In this manner, hanging interlock clasp 40 expands apart as illustrated in FIGS. 10 and 11. This flexing action combined with the pressure of the user allows neck 56 of engagement button 50 to be released up and out of the hanging interlock clasp 40 through the channel that is comprised of surfaces 53L and 53R as shown in FIG. 5. This flexing movement in some instances may force the movement of 44L and 44R up and out along the curved leg of D-ring 30 and then back in and down again as the upward pressure is released.

Alternate Attachment Options

Figure 23:
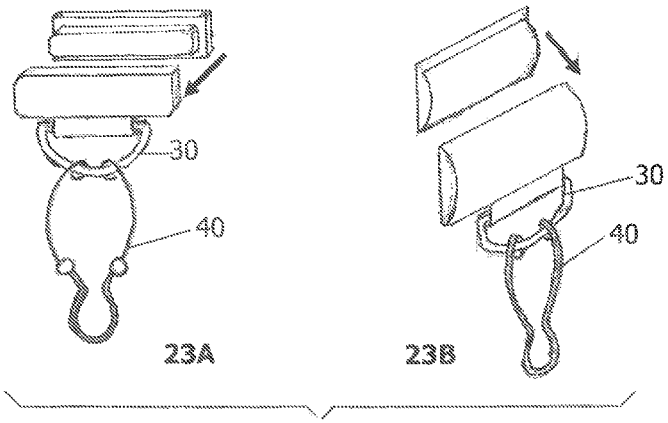
FIGS. 23A and B illustrate an alternate embodiment of a way to connect the gadget-holding device 10 to clothing in a manner other than a clip 20. As shown, a magnet pair can be used to connect to clothing (with each member of the pair on different sides of the piece of clothing). In this embodiment, it is also preferred to also use a mechanical male/female connection to strengthen the connection. Those in the art can devise a myriad of ways to accomplish this.
Figure 24:
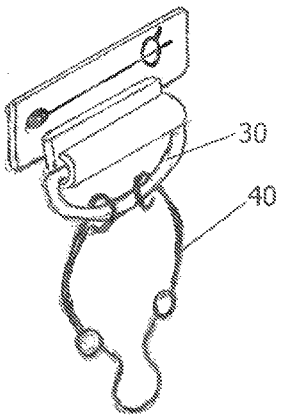
FIG. 24 illustrates an alternate embodiment of a way to connect the gadget-holding device 10 to clothing in a manner other than a clip. As shown, a pin/clasp pair can be used to connect to clothing. Those in the art can devise a myriad of ways to accomplish this.
Figure 27:
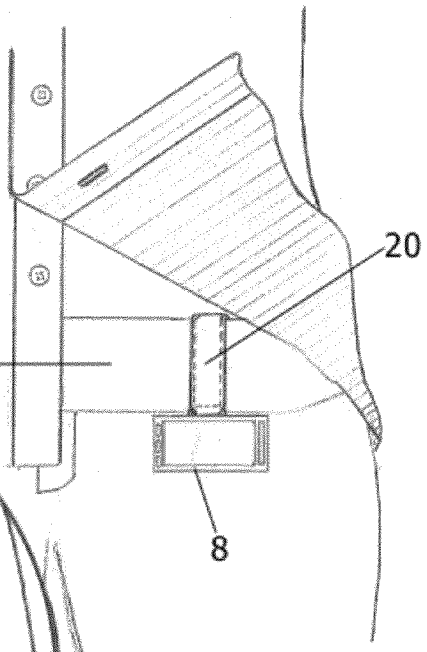
FIG. 27 illustrates how the preferred embodiment is worn on a belt 22 in the ordinary course, with the gadget in the landscape position.
Figure 26:
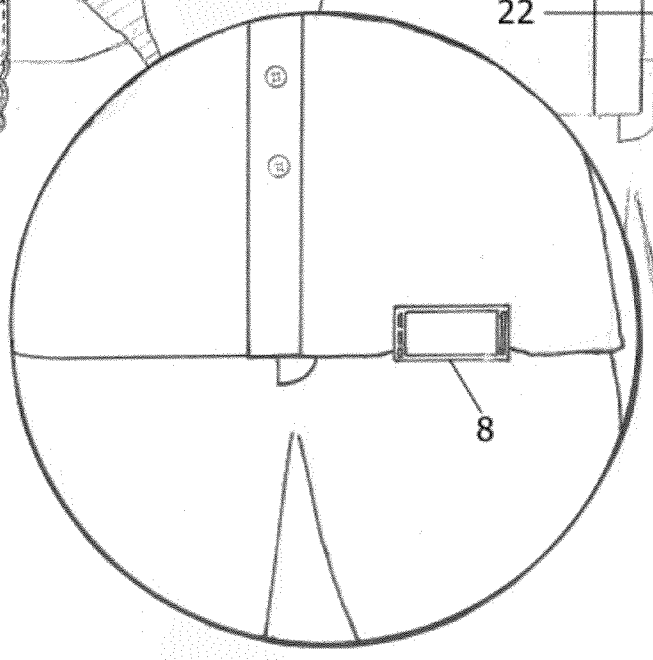
FIG. 26 illustrates how the preferred embodiment is worn on a belt 22 in the ordinary course, with the gadget in the landscape position.
Figure 25:
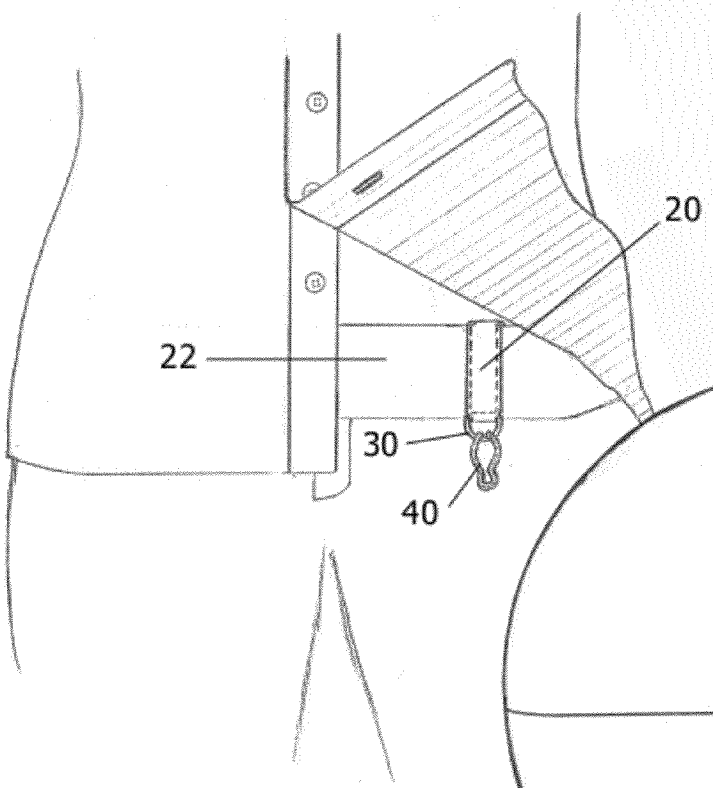
FIG. 25 illustrates how the preferred embodiment is worn on a belt 22.

Sometimes a waistband or pocket is not available, for instance when a woman wears a dress. There are dresses that are informal such as a sun dress or the like that does not contain a pocket and one may still have a desire to have a gadget such as a cell phone available on their person for sake of convenience. In such an instance it would be desirable to have a gadget-holding device that had the ability to attach to the fabric in an alternate manner such as with a decorative pin and/or with very strong magnets that mate together on either side of the fabric to create a connection that does not slip when the weight of a gadget is attached. FIGS. 23A, 23B and 24 illustrate some of the possible alternate embodiments.

Presently Preferred Embodiment

Figure 35:
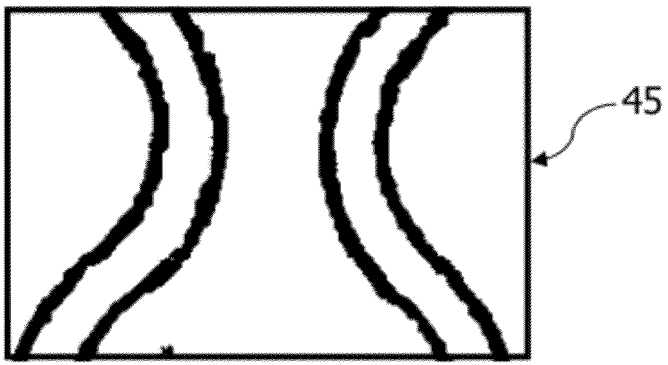
FIG. 35 illustrates an enlarged view of the slide lock channel 45 for the embodiment shown in FIG. 8.

FIG. 35 illustrates a suitable but not presently preferred embodiment of slide-lock channel 45 of the slide-lock 42 shown of FIG. 8. The slide-lock channel 45 shown in FIG. 35 is symmetrical about its x and y axis. In addition, the hourglass shape has smooth curves throughout. In contrast, FIGS. 28-34 and 36 illustrate the presently preferred embodiments of the gadget-holding device 10, the hanging interlock clasp 40 and slide-lock channel 45.

Figure 36:
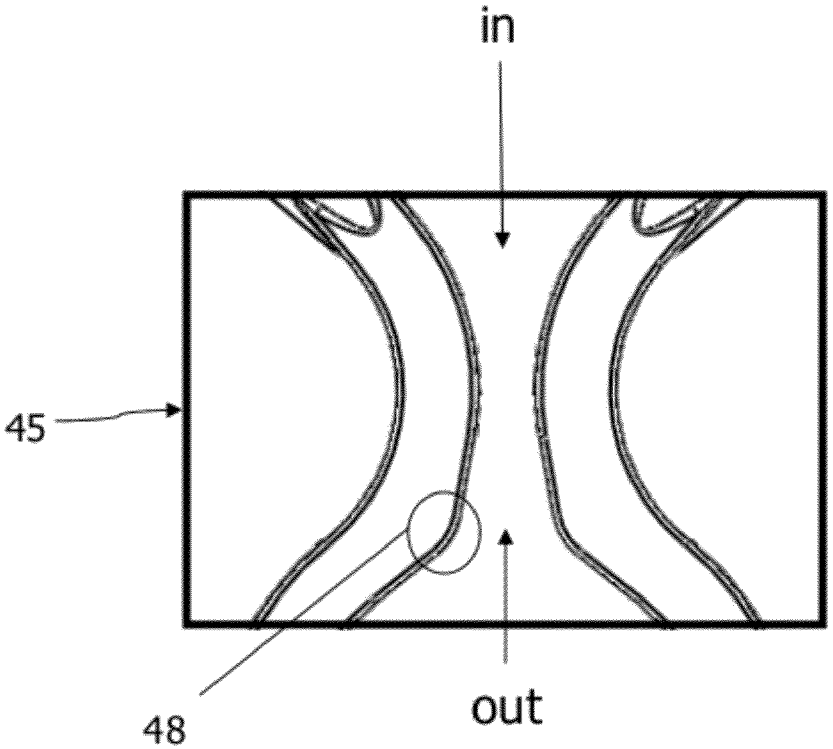
FIG. 36 illustrates an enlarged view of the slide lock channel 45 for the preferred embodiment shown in FIG. 30-34.

When comparing FIG. 35 to FIG. 36, the top-half of slide-lock channel 45 remains similarly, if not identically, shaped. But the bottom-half of slide-lock channel 45 is different because blunt corner 48 of FIG. 36 allows the slide-lock 42 to more fully enclose around neck 56 of button 50 and does not allow button 50 to easily slip back out once it is engaged in slide-lock 42.

More specifically, as shown in FIG. 36, the engagement button 50 will face the same smooth entry on its way into the preferred slide-lock 42 as in FIG. 35. But engagement button 50 will encounter more resistance on its way out of the preferred slide-lock 42. Blunt corner 48 is one way to achieve the preferred function of greater resistance going out than coming in but other ways could be devised by those in the art.

The shape difference between the slide-lock channel 45 shown in FIG. 35 and the slide-lock channel 45 shown in FIG. 36 has been found to create the preferred function where the engagement button 50 does not disengage from the slide-lock 42 without deliberate force from directly above at the top of the interlock clasp 40 and the bottom of the engagement button 50 (such force will typically originate the bottom of gadget and transfer to the engagement button 50 as shown as shown in FIG. 15).

FIGS. 28-34 illustrate the preferred way to join slide lock 42 and extension loops 44L and 44R. For ease during the assembly process and to make a more reliable product, it is preferred to integrate the extension loops 44L and 44R with the slide-lock 42 using a molding process known in the art. As previously discussed and as illustrated in FIGS. 1-17, it is suitable to use a slide lock 42 having ball-shaped ends that can be drilled deep enough to accept the ends of extension loops 44L and 44R but that method is not presently preferred.

It is preferred that slide-lock 42 is made out of material sold by DuPont under the trademark DELRIN®, but other materials known in the art would be suitable. Likewise, it is preferred that extension loops 44L and 44R be constructed from sturdy gauge wire and bent into the ideal shape (as shown in the illustrations) with the one extension loops mirroring the other, although other materials are suitable. Extension loops 44L and 44R can be placed opposite of each other in a mold that has been specifically engineered for the purpose of creating the lower portion of the slide lock. Delrin or other suitable material is heated into liquid form and then injected into the mold. As the Delrin cools it hardens into the desired shape, encasing the lower portions of the extension loops 44L and 44R into the plastic. This procedure creates a durable bond of metal to plastic during the manufacturing process.

Figure 29:
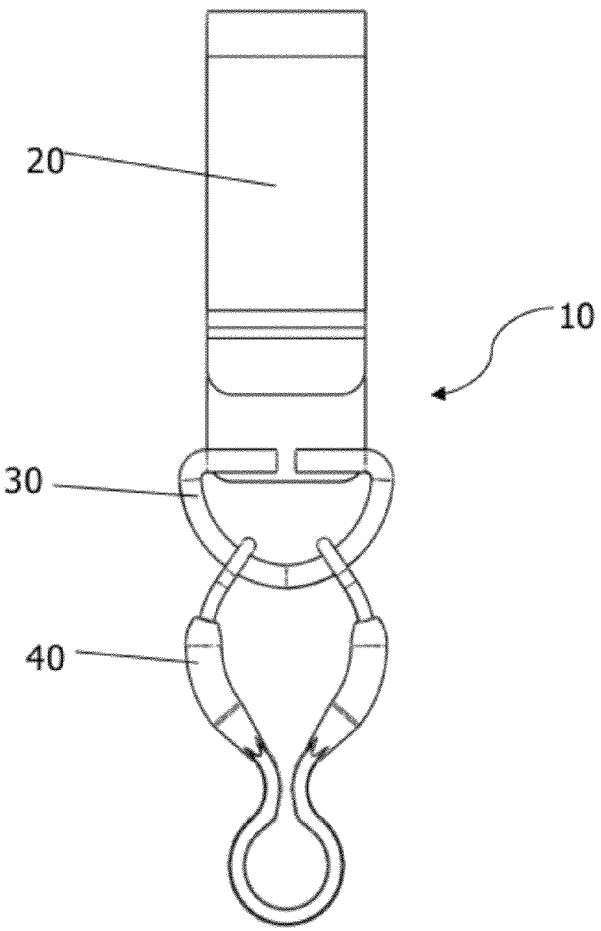
FIG. 29 illustrates a back view of the preferred embodiment of the gadget-holding device 10.
Figure 28:
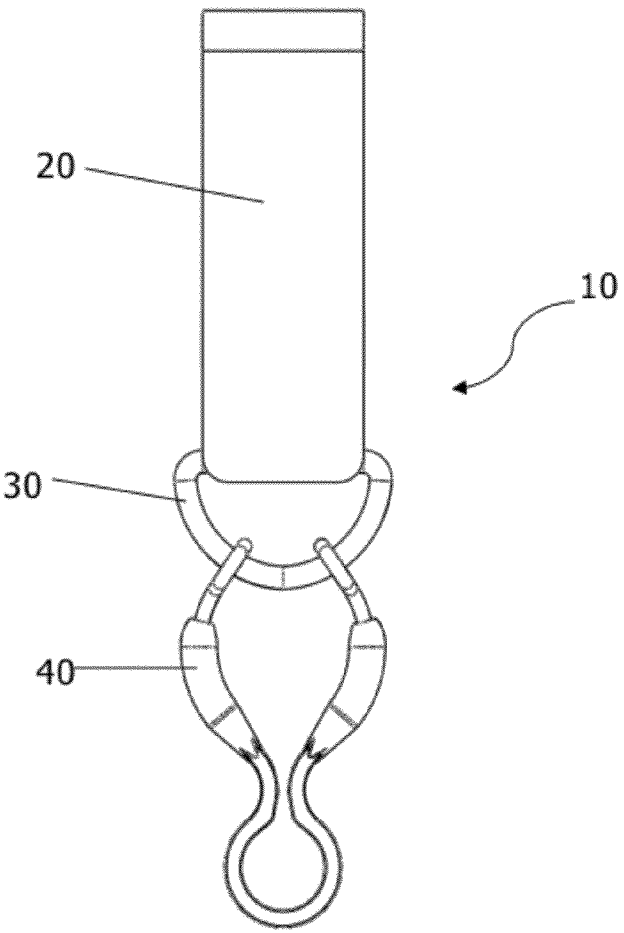
FIG. 28 illustrates a front view of the preferred embodiment of the gadget-holding device 10.
Figure 32:
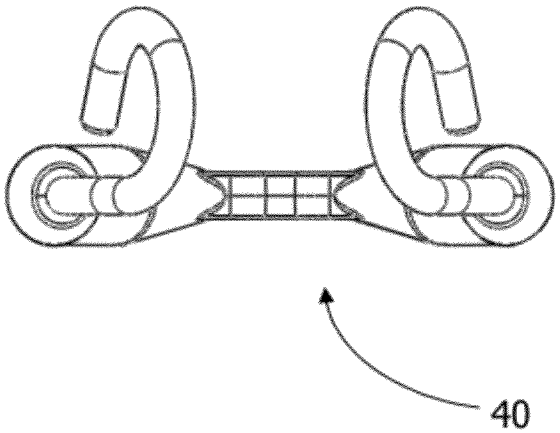
FIG. 32 illustrates a top view of the preferred embodiment of the hanging interlock clasp 40.
Figure 31:
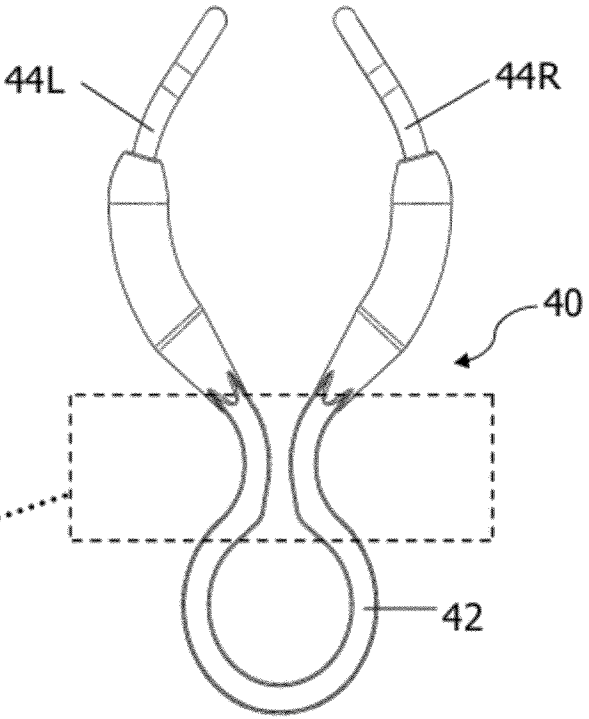
FIG. 31 illustrates a front view of the preferred embodiment of the hanging interlock clasp 40.
Figure 30:
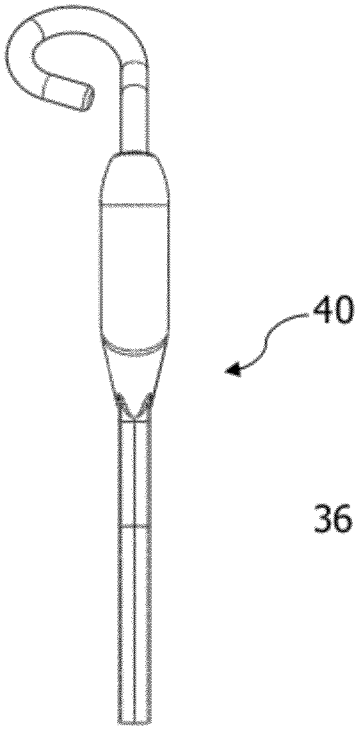
FIG. 30 illustrates a side view of the preferred embodiment of the hanging interlock clasp 40.
Figure 34:
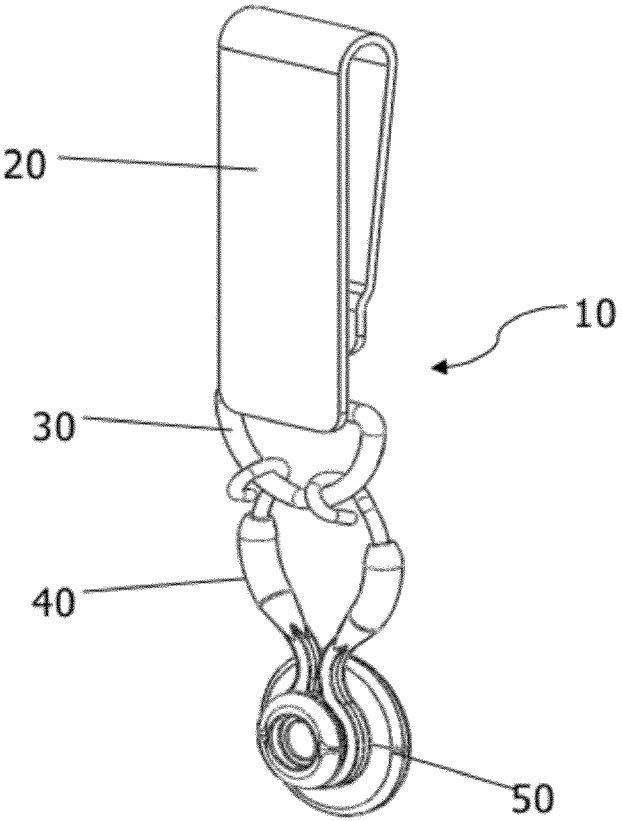
FIG. 34 illustrates a perspective view of the preferred embodiment of the gadget-holding device 10.
Figure 33:
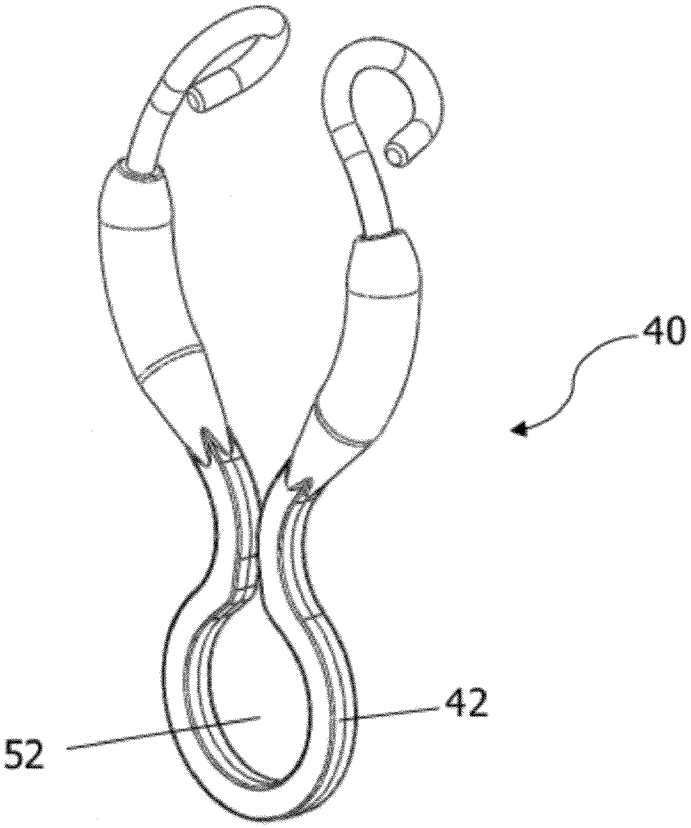
FIG. 33 illustrates a perspective view of the preferred embodiment of the hanging interlock clasp 40.

While several of the drawings illustrate D-ring 30 being directly connected to clip 20, see, e.g., FIG. 1, it is preferred that D-ring 30 is not directly attached to the metal clip but is instead attached via a leather or fabric covering of clip 20 as shown, for example, in FIG. 18. FIGS. 28-29 do not show an actual connection between clip 20 and D-ring 30 because the preferred fabric is not shown for clarity of the other connections. Of course, while FIG. 18 illustrates the preferred embodiment covered, it certainly does not represent every way that the end product might visually be finished i.e., stitching differences, embellishments and the way that the fabric wraps the top of the metal rings.

Although the invention has been described in detail with reference to one or more particular preferred embodiments, persons possessing ordinary skill in the art to which this invention pertains will appreciate that various modifications and enhancements may be made without departing from the spirit and scope of the claims that follow.

What is claimed is:

1. A gadget-holding device comprising, a clip, a connector, a hanging interlock clasp, and an engagement button for connecting to a gadget, wherein the connector is connected between the clip and the hanging interlock clasp, the hanging interlock clasp further comprising a slide-lock channel for slidably securing and slidably unsecuring a neck of the engagement button within the hanging interlock clasp, wherein the slide-lock channel comprises a pair of opposing, expandable sides for matably accepting the neck of the engagement button, and wherein the connector can rotate relative to the clip and wherein the hanging interlock clasp can rotate and slide relative to the connector.

* * * * *